United States Patent [19]

Evans

[11] 4,363,233

[45] Dec. 14, 1982

[54] METHOD AND APPARATUS FOR COLD FORMING STABILIZER BLADE MEANS FROM ELONGATED MEMBERS

[76] Inventor: Ernest G. Evans, P.O. Box 52144, Lafayette, La. 70505

[21] Appl. No.: 219,528

[22] Filed: Dec. 23, 1980

[51] Int. Cl.[3] ..... B21D 11/14

[52] U.S. Cl. ..... 72/383; 72/299

[58] Field of Search ..... 72/383, 298, 299, 371, 72/301, 295

[56] References Cited

U.S. PATENT DOCUMENTS 194,409 8/1877 Braun ..... 72/383

2,321,951 6/1943 Susskind ..... 72/383

2,892,479 6/1959 Holsclaw ..... 72/383

*Primary Examiner*—Gene Crosby

*Attorney, Agent, or Firm*—Jack W. Hayden

[57] ABSTRACT

An apparatus for cold forming stabilizer blades from elongated members by holding an elongated member while being bent or twisted to form a stabilizer blade. A mandrel is provided for receiving first and second sleeves so that a force applied by a toggle arrangement causes the first and second sleeves to rotate in opposite directions to bend the elongated member to form a stabilizer blade.

5 Claims, 7 Drawing Figures

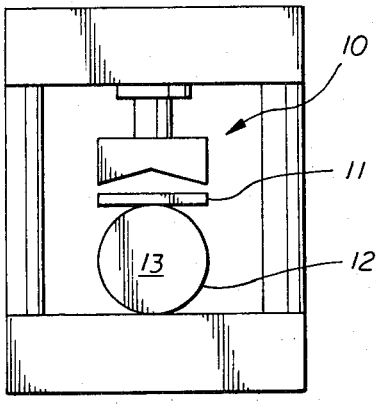
fig.1 (PRIOR ART)
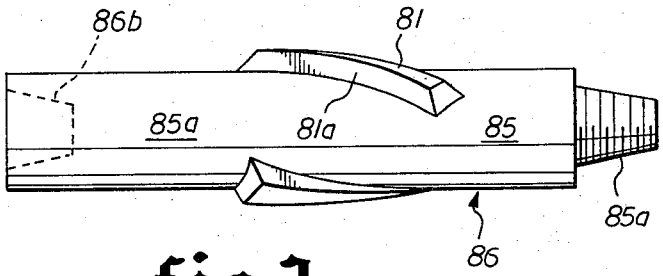
fig.2
fig.3
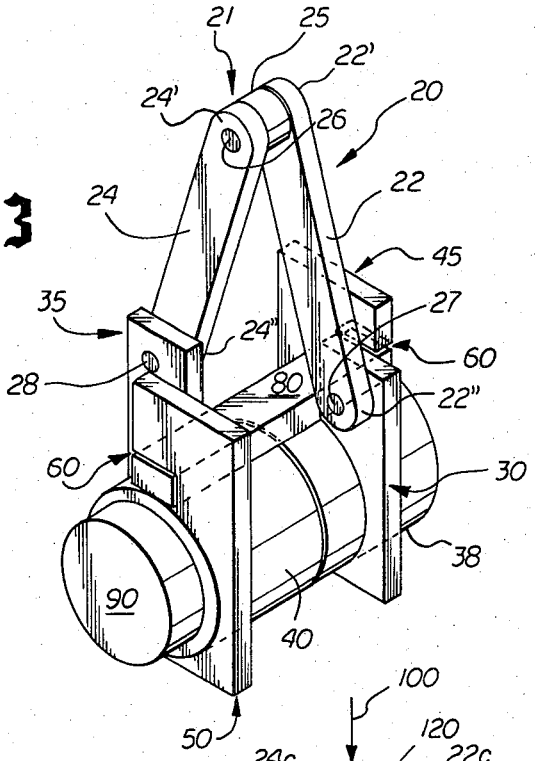
fig.4
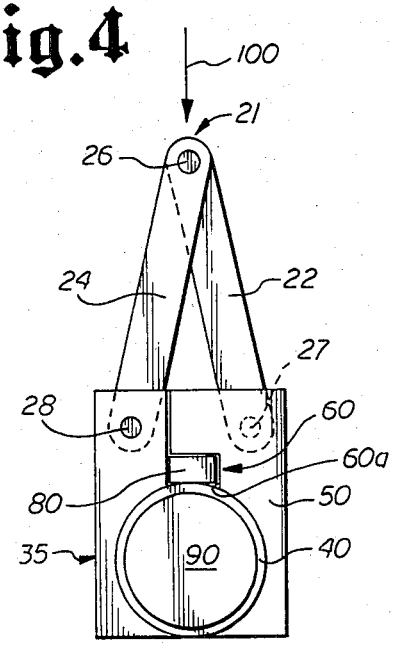
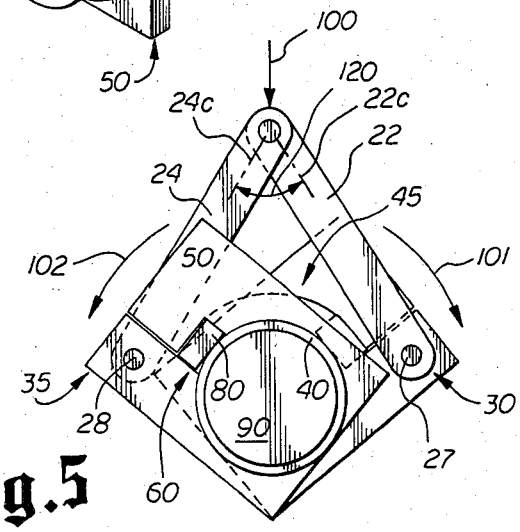
fig.5

METHOD AND APPARATUS FOR COLD FORMING STABILIZER BLADE MEANS FROM ELONGATED MEMBERS

SUMMARY OF THE INVENTION

A commonly used oil well drilling tool is a welded blade stabilizer, which generally consists of a body that normally matches the drill collars in size and strength and any suitable number, such as three (3), spiralled blades which serve as a bearing surface keeping the drill string centered in the well bore. One of the most difficult parts of manufacturing these tools is forming the blades in a spiralled or helical shape to fit the tool body. The blades are typically sixteen to eighteen inches long, and by way of example only, two to three inches wide and one to six inches high. These demensions result in a relatively high moment of inertia (stiffness) which makes bending the member very difficult. Most shops have found that the only effective method is to heat the elongated members from which the blades are to be formed to a "cherry red" temperature and place them at an angle on a mandrel and then push down on the ends with suitable means such as a hydraulic press. This method presents a hazard to the operator plus requires an extremely large press if heat is not used. This method will also not necessarily produce a close fit between the bent blades and tool body since the ends of the blades have a tendency to spring back when the load from the press or other means is released from the heated elongated member. The present invention eliminates the necessity of heating elongated members to form the blades. In a day of energy consciousness and shortages this is a significant factor both in economy and conservation.

The present invention also enables the elongated members to be formed in a manner so that a permanent set can be obtained by cold forming the blades, with the resulting bent or twisted blades retaining their bent and twisted form so that a better fit is obtained between the resulting bent blade and tool body on which it is to be employed.

Another object of the present invention is to provide a method of cold forming stabilizer blades from elongated members wherein the force or torque applied to the members to form the resulting stabilizer blades increases as the bending of the elongated members is effected.

Other objects and advantages of the present invention will become more readily apparent from a consideration of the following description and drawings.

BRIEF DESCRIPTION OF THE DRAWINGS

FIG. 1 is a schematic view illustrating one arrangement employed by the prior art to form stabilizer blades from elongated members;

FIG. 2 is a perspective view of a stabilizer tool including a tool body with stabilizer blade thereon and threaded means to enable each end of the tool body to be threadedly secured in a well string;

FIG. 3 is a perspective view of one form of the present invention;

FIG. 4 is an end view of the form of the invention illustrated in FIG. 3;

FIG. 5 diagrammatically illustrates the position of the components of the form of the invention shown in FIG. 3 when a force is applied thereto to effect bending of an elongated member to form a stabilizer blade;

DESCRIPTION OF THE PREFERRED EMBODIMENTS

Figure 7:
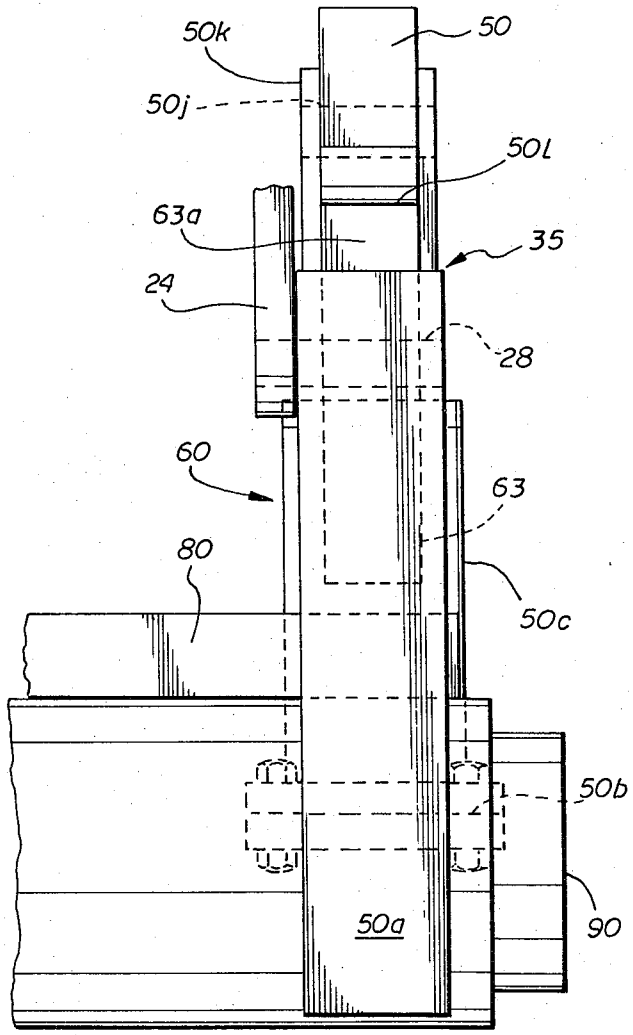
FIG. 7 is an edge view on the line 7—7 of FIG. 6 illustrating further details of the components of the invention of the FIG. 6 modification.

In referring to the drawings, FIG. 1 illustrates one arrangement of the prior art wherein a hydraulic press referred to generally by the numeral 10 is employed to apply a bending force to an elongated member 11 to bend it in a desired manner to conform with the contour of the surface 12 on the mandrel 13. As noted previously, it is not unusual for the ends of the member 11 to tend to spring away from the surface 12 after the heater member 11 has been bent and held in such position by the hydraulic press 10.

The arrangement of the present invention enables a force to be applied to a member, such as an elongated member, to form a stabilizer blade in a manner so that as the force is applied, the resulting torque increases to assist in cold forming the elongated member into a stabilizer blade. Also, the contstruction and arrangement of the components of the present invention are such that the cold formed stabilizer blade will more closely fit the surface on which it is to be employed, and will retain its bent and twisted shape even after the bending and twisting force is removed therefrom.

Attention is directed to FIG. 3 of the drawings wherein one form of the present invention is illustrated and is referred to generally by the numeral 20. The apparatus 20 includes toggle joint means referred to generally by the numeral 21, which toggle joint means includes a first bar means 22 and a second bar means 24 which are pivotally connected adjacent one of their ends 22' and 24' by any suitable means such as a pivot pin 26 extending through the ends and through the spacer 25 positioned between the ends 24' and 22' to offset them laterally as illustrated in FIG. 3 of the drawings.

The other end of the first bar means, which end is designated as 22'', is pivotally connected with the other end of first means referred to generally by the numeral 30.

The other end 24'' of the second bar means 24 is pivotally connected to a second means referred to generally by the numeral 35. It will be noted that the end 22'' of the first bar means 22 is pivotally connected to the first means 30 by any suitable means such as the pivot pin 27. Similarly, a pivot pin 28 connects the other end 24'' of the bar means 24 with the second means 35.

The first means 30 and the second means 35 are each connected with a first sleeve means 38 and second sleeve means 40 which move independently of each other. The first means 30 may be secured to the first sleeve means 38 by any suitable means such as welding or the like and similarly the second means 35 may be secured with the second sleeve means 40 in any suitable manner such as by welding or the like.

First clamping means referred to generally by the numeral 45 is mounted by any suitable means such as welding or the like on the first sleeve means 38 and second clamping means referred to generally by the numeral 50 are mounted by any suitable means such as welding or the like on the second sleeve means 40.

The first and second clamp means 45 and 50 are each provided with suitable retaining means 60 to receive and position an elongated member such as that represented generally at 80 to hold it while the stabilizer blade is formed from the elongated member 80.

Mandrel means 90 may also be employed upon which the sleeve means 38 and 40 may be positioned as the device is actuated to form the elongated member 80 into a twisted stabilizer blade such as that represented at 81 on the tool body 85 of the stabilizer device referred to generally by the numeral 86 in FIG. 2 of the drawings. It should be noted that the tool body 85 is elongated and is generally tubular to accommodate fluid flow therethrough during normal drilling operations and is also provided with a threaded pin end 85*a* and a threaded box end illustrated generally by the numeral 86*b* in dotted line so that the tool body 85 may be secured in a drill string or other well string in which it is to be employed.

In operation of the present invention, it will assume firstly the general position shown in FIGS. 3 and 4 of the drawings wherein the toggle joint means 21 is at its retracted or nonexpanded or nonrotated position. This position is clearly illustrated in FIG. 4 of the drawings. It is to be further noted that the form of retaining means 60 illustrated in the modification of FIGS. 3–5 respectively, is in the form of an opening or notch 60*a* formed in the first and second clamping means 45 and 50, such opening 60*a* being of a suitable size to snugly fit the elongated member 80 when it is positioned in each of the openings 60*a* to retain it as it is cold formed or twisted to provide the stabilizer blade configuration as illustrated in 81 of FIG. 2.

As a downward force as represented by the arrow 100 in FIG. 4 is applied adjacent the ends 24' and 22' of the toggle joint 21, the toggle joint 21, and more specifically the arms 22 and 24 thereof by reason of the pivotal connection with the first sleeve means 38 and second sleeve means 40, respectively, began to rotate with such sleeve means. When the sleeve means 38 and 40 began to rotate, the first means 30 and second means 35 also began to rotate in opposite directions as represented by the arrows 101 and 102 in FIG. 5. Also, the clamping means 45 and 50 move in the same direction as the arrows 101, 102, respectively, as better seen in FIG. 5 of the drawings.

As such rotation occurs, a resulting force is applied adjacent each end of the elongated member 80 to twist it in generally a helical pattern so as to form the stabilizer blade of a configuration as shown at 81 in FIG. 2.

The arrangement of the components of the present invention is such that as a force represented by the arrow 100 in each FIGS. 4 and 5 is applied to the upper end of the toggle joint 21 in a downward direction, the resulting torque applied to the ends of the elongated member 80 by the clamping means 45 and 50 increases as the angle increases between the first bar means 22 and the second bar means 24, such angle being represented by the arrow 120 extending between the dotted line 24*c* extending along the longitudinal axis of second bar means 24 and the dotted line 22*c* extending along the longitudinal axis of the bar member 22. This method imparts high forces to the elongated member 80 enabling it to be shaped into a stabilizer blade without applying heat. Also, the method of forming the stabilizer blade causes it to better retain its shape after the bending force has been removed therefrom.

Further, the arrangement of the first and second sleeve means may be such that the resulting stabilizer 81 can be built the same size as the stabilizer body 85 and thereby provide a more perfect fit between the stabilizer blade 81 and circumferential surface 85*a* on the tool body 85. This can be accomplished by providing sleeves 38 and 40 of the same size as the stabilizer body 85 whereby the resulting stabilizer blade 81 will form a more perfect fit with the surface 85*a* of the tool body 85 upon which it is to be employed. This is of importance in terms of appearance as well as saving welding time and materials since there are no excessive gaps to fill with weld metal when the curvature of the nether surface 81*a* of the cold formed stabilizer blade of the present invention closely fits the circumferential surface 85*a* of the tool body 85.

It can be appreciated that the method and apparatus of the present invention can be employed to build or form a stabilizer blade 85*a* whose direction of curvature or the direction of the helix is opposite to that as represented in FIG. 2 of the drawings. This may be accomplished by transposing the position of the components of the apparatus shown in FIG. 3 so that rotation of the sleeve means 38 and 40 is effected in an opposite direction when a downward force 100 is applied to the upper end of the toggle joint 21. Since the position of the bar members 24 and 22 has been reversed, as well as the position of the clamping members on the sleeves 38 and 40 to enable them to rotate in a direction opposite to that illustrated in FIGS. 3–5, a stabilizer blade may be produced that is "left hand" in its spiral direction which may be required from time to time.

Figure 6:
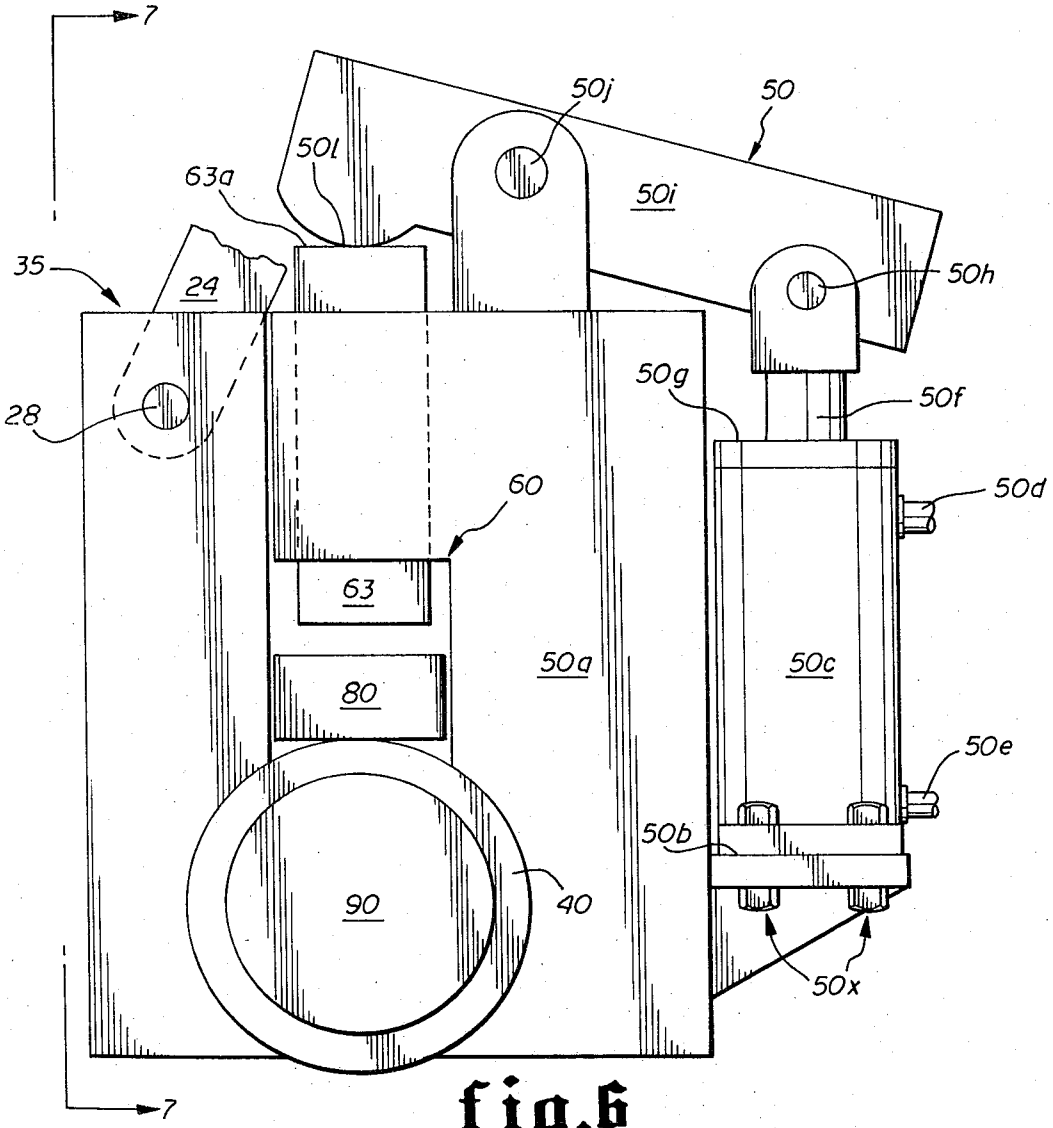
FIG. 6 is an end view of an alternate form of the present invention and shows a hydraulic power arrangement to clamp and retain an elongated member in position as it is bent and twisted to form a stabilizer blade.

FIGS. 6 and 7 illustrate an alternate embodiment of the present invention wherein the second sleeve means is again illustrated at 40 and the second means 35 is secured thereto as described with the embodiment of FIGS. 3–5 inclusive. The second bar means 24 is pivotally connected thereto by the pin 28 and is mounted as otherwise described with regard to the FIGS. 3–5 modification. In FIGS. 6 and 7 only a partial view is shown, it being understood that the other end is similar to that described with regard to FIGS. 6 and 7. Indeed, the only change in FIGS. 6 and 7 as compared with the modification illustrated in FIGS. 3–5, inclusive, is that the form of the clamping means 45 and 50 is identical to that shown by the clamping means 50 in FIGS. 6 and 7.

In such arrangement, the clamping means 50 includes a body 50*a* that is welded or otherwise secured to the second sleeve means 40 and is provided with a projection 50*b* for receiving and seating the double-acting hydraulic cylinder 50*c*. The double-acting hydraulic cylinder is provided with connections 50*d* and 50*e* for supplying hydraulic fluid thereto to move a piston in such hydraulic cylinder 50*c* up or down to effect actuation and release of the member 60 by the first clamping means 50.

A piston rod 50*f* is shown as extending out the top 50*g* of the hydraulic cylinder 50*c* and is pivotally connected by any suitable means such as the pin 50*h* to the clamping arm 50*i*, which clamping arm 50*i* is also pivotally connected as shown at 50*j* to the body 50*a* by means of the projection 50*k* which extends upwardly from the upper end of the body 50*a* as shown in FIG. 6 of the drawings. The clamping arm 50*i* is provided with a depending projection 50*l* for effecting movement of a slidable member referred to at 63. The slidable member may be carried in any suitable manner by the body 50*a* to enable the slidable member 63 to move longitudinally relative to the body 50*a* as shown in FIG. 6 of the drawings.

As noted previously, FIGS. 6 and 7 describe and show only one end of the apparatus, it being understood that the first clamping means 45 is similar in arrangement to that described with regard to the second clamping means 50 shown in detail in FIGS. 6 and 7.

It should also be noted that the hydraulic cylinder may be mounted on the lateral projection 50*b* by any suitable means such as the nut and bolt referred to generally at 50*x* in FIGS. 6 and 7.

When it is desired to move the slidable means or member 63 into retaining engagement with the elongated member 80 while the apparatus is actuated to twist the member 80 to form a helical or generally helical shaped stabilizer as illustrated in 81 of FIG. 2, hydraulic fluid may be supplied through the inlet 50*e* to cause the piston rod 50*f* and piston (not shown) carried by 50*c* to move upwardly within hydraulic cylinder 50*c*. As the piston rod 50*f* moves upwardly, the clamping arm 50*i* by reason of the pivotal connections 50*h* and 50*j* causes the depending projection 50*l* to move downwardly into engagement with the upper end 63*a* of the slidable means 63 mounted on body 50*a* by any suitable means as previously noted. This forces the slidable means 63 down into engagement with the elongated member 60 to retain it in such position as a downward force 100 as previously described with regards to FIGS. 4 and 5 as applied to the upper end of the toggle joint 21 (not shown in FIGS. 6 and 7).

This arrangement serves to clamp and hold the elongated member 60 as the toggle joint is moved downwardly to force the arms 22 and 24 apart and thereby rotate the sleeves 38 and 40 in opposite directions in a manner as described with regard to the FIGS. 3–5 modification. The operation and function of the arrangement of FIGS. 6 and 7 is similar to that described with regard to the FIGS. 3–5 embodiment. After the elongated member 80 has been cold shaped into the desired helical left or right hand configuration for any particular size or suitable size body 85, the pressure is released from the passage 50*e* and if necessary fluid may be conducted through conduit 50*d* to the hydraulic cylinder 50*c* to enable the slidable means 63 to move upwardly away from the helically cold formed stabilizer blade and to enable the stabilizer blade to be removed from the apparatus.

The apparatus and method of the present invention secures the elongated member 80 only adjacent each end thereof and holds it while it is formed into the stabilizer blade shape as represented by the blade 81 in FIG. 2.

The member is formed by the toggle joint means 21, first and second sleeve means 38 and 40 and clamping means 60 cooperating to apply a force which acts on the member 80 adjacent each end thereof, with the force adjacent one end being generally in a direction opposite to the force on the other end of the member 80. This is illustrated in detail in the description of FIGS. 3–5, inclusive.

The foregoing disclosure and description of the invention are illustrative and explanatory thereof, and various changes in the size, shape and materials as well as in the details of the illustrated construction may be made without departing from the spirit of the invention.

What is claimed is:

1. An apparatus for cold forming stabilizer blades from elongated members comprising:

a. toggle joint means including:
   1. first and second bar means pivotally connected adjacent one end;
   2. first sleeve means pivotally secured to the other end of said first bar means; and
   3. second sleeve means pivotally secured to the other end of said second bar means;

b. first and second clamping means on said first and second sleeve means respectively including retaining means to receive and position an elongated member for forming the stabilizer blade; and c. mandrel means for receiving said sleeve means so that a force applied to spread apart said first and second bar means rotates said first and second sleeve means in opposite directions on said mandrel to rotate said first and second bar means away from each other to bend the elongated member to form a stabilizer blade.

2. The apparatus of claim 1 wherein said retaining means includes opening means to receive the elongated member in each said first and second clamp means.

3. The apparatus of claim 1 wherein said retaining means includes:

a. first slidable means carried by said first clamping means;

b. second slidable means carried by said clamping second means; and c. power means to move said first and second slidable means into and out of engagement with an elongated member to receive and position it while it is formed into a stabilizer blade.

4. The apparatus of claim 3 wherein said power means is hydraulically actuated power means; and a clamping arm pivotally connected to said hydraulically actuated power means and to one of said clamping means whereby said clamping arm may be moved into engagement with one of said first and second slidable means and urge said one of first and second slidable means against an elongated member to hold it while it is bent to form a stabilizer blade.

5. The apparatus of claim 1 wherein:

a. said first sleeve means include first means secured to said first sleeve means to rotate therewith;

b. means for pivotally connecting said first means with the other end of said first bar means;

c. said second sleeve means include second means secured to said second sleeve means to rotate therewith; and d. means for pivotally connecting said second means with the other end of said second bar means.

* * * * *